US010380880B1

(12) United States Patent
Darling et al.

(10) Patent No.: US 10,380,880 B1
(45) Date of Patent: Aug. 13, 2019

(54) METHODS OF AND DEVICES FOR FILTERING TRIGGERED ALARM SIGNALS

(71) Applicant: Instant Care, Inc., Vista, CA (US)

(72) Inventors: Richard Allen Darling, Poway, CA (US); Fong-Min Chang, Diamond Bar, CA (US); Chih-Cheng Tai, Campbell, CA (US)

(73) Assignee: INSTANT CARE, INC., Escondido, CA (US)

( * ) Notice: Subject to any disclaimer, the term of this patent is extended or adjusted under 35 U.S.C. 154(b) by 0 days.

(21) Appl. No.: 15/471,323

(22) Filed: Mar. 28, 2017

Related U.S. Application Data

(60) Provisional application No. 62/421,872, filed on Nov. 14, 2016, provisional application No. 62/421,888, filed on Nov. 14, 2016, provisional application No. 62/421,900, filed on Nov. 14, 2016.

(51) Int. Cl.
*G08B 29/00* (2006.01)
*G08B 29/18* (2006.01)
*G08B 25/00* (2006.01)

(52) U.S. Cl.
CPC ..... *G08B 29/185* (2013.01); *G08B 25/001* (2013.01)

(58) Field of Classification Search
None
See application file for complete search history.

(56) References Cited

U.S. PATENT DOCUMENTS

2005/0206513 A1* 9/2005 Fallon ..... G08B 25/012 340/506
2005/0280704 A1* 12/2005 Clare ..... G08B 13/1672 348/143
2006/0126085 A1* 6/2006 Owen ..... H04N 1/465 358/1.9
2007/0139183 A1* 6/2007 Kates ..... G08B 25/005 340/521
2007/0182540 A1* 8/2007 Marman ..... G06K 9/00362 340/506
2009/0320088 A1* 12/2009 Gill ..... G06F 21/604 726/1
2013/0183924 A1* 7/2013 Saigh ..... H04W 4/029 455/404.2
2014/0340540 A1* 11/2014 Krapf ..... H04N 5/23293 348/222.1
2016/0082993 A1* 3/2016 Peltz ..... B61L 25/021 701/32.4
2016/0300465 A1* 10/2016 Britton ..... G08B 13/19682
2017/0294089 A1* 10/2017 Miwa ..... H04W 12/06

* cited by examiner

*Primary Examiner* — John F Mortell
(74) *Attorney, Agent, or Firm* — Platinum Intellectual Property LLP

(57) ABSTRACT

A method of the device for reducing false alarm notification to call center comprises receiving a triggered abnormal status notification by a user's device and having a user to assist processing information of the notification or filtering false alarms before the notification is transmitted to/processed by a call center. The filtering of the false alarms can be achieved by using a dismiss button on a touchscreen, receiving a user's voice command, and/or verifying the user's identity and permission level using one or more biometric identifiers.

16 Claims, 6 Drawing Sheets

METHODS OF AND DEVICES FOR FILTERING TRIGGERED ALARM SIGNALS

CROSS-REFERENCE TO RELATED APPLICATION(S)

The present invention claims priority to the U.S. provisional patent application Ser. No. 62/421,900 titled "METHODS OF AND DEVICES FOR IMPROVING CALL CENTER EFFICIENCY," filed on Nov. 14, 2016, the U.S. provisional patent application Ser. No. 62/421,872 titled "METHOD OF AND DEVICE FOR EXTENDING AND TRANSFORMING WARNING SIGNALS," filed on Nov. 14, 2016, and the U.S. provisional patent application Ser. No. 62/421,888 titled "METHOD OF AND DEVICE FOR CONVERTING LANDLINE SIGNALS TO WI-FI SIGNALS AND USER VERIFIED EMERGENCY ASSISTANT DISPATCH," filed on Nov. 14, 2016, which are incorporated by reference in their entirety for all purposes.

FIELD OF INVENTION

The present invention relates to emergency response services. Specifically, the present invention relates to home and personal security alarm systems and care helpline notification systems.

BACKGROUND OF THE INVENTION

Typically, triggered warning signals of a security system (e.g., a home security system) are directly sent to a service providing unit (e.g., a call center, a home security monitoring and response center, or Tele-Medical Call Center). Such warning signals generally require the service providing unit to maintain a service person that calls a designated person of the service subscriber to confirm a dispatch of an emergency assistant (e.g., police, fire, or ambulance) or to dismiss the warning signal, which takes substantial resources including numbers of service people and engaged service time. Nonetheless, a large ratio/number of all the warning signals are false alarm or situations that do not require the emergency assistant, which results in inefficiency in terms of wasted man hours for all service providers.

SUMMARY OF THE INVENTION

Methods of and devices for providing assisted service to the servicing providing unit are disclosed. In some embodiments, the assisted service is provided by using a filtering device/process to reduce the time and staff required for handling incoming calls. In another embodiment, the assisted service is provided to allow the user to provide assisted information to the service providing unit to enhance the unit's information processing efficiency.

In an aspect, a method of reducing false alarm notification to call center comprises receiving a triggered alarm notification onto a user's mobile device and filtering the triggered alarm notification on the user's mobile device. In some embodiments, the filtering comprises allowing the user to dismiss a false alarm by providing an alarm dismiss button on a touchscreen for the user to dismiss the triggered alarm notification. In other embodiments, the filtering comprises allowing the user to request a service. In some other embodiments, the filtering comprises dismissing a false alarm by providing a voice command to cancel the triggered alarm notification. In some embodiments, the filtering comprises dismissing a false alarm by verifying the identity and permission level of the user. In other embodiments, the verification of the identity of the user is performed using a passcode or password. In some other embodiments, the verifying of the identity of the user is performed using one or more biometric identifiers. In some embodiments, the filtering comprises dismissing a false alarm by instructing the user to click a mechanical button.

In another aspect, a method of reducing a number of false alarms to a call center comprises monitoring a premise using one or more sensors, sending a triggered alarm signal to a user's mobile device, and allowing the user to dismiss the triggered alarm signal as a false alarm on the user's mobile device. In some embodiments, the method further comprises allowing the user to confirm a trigger alarm event using the user's mobile device. In other embodiments, the method further comprises allowing the user to dismiss the triggered alarm signal by entering a command on a computer generated graphic user interface (GUI) button. In some other embodiments, the method further comprises allowing the user to dismiss the triggered alarm signal by entering a command using a non-GUI based mechanism. In some embodiments, the non-GUI based mechanism comprises a voice command to dismiss the triggered alarm signal. In other embodiments, the method further comprises using the user's mobile device to control an alarm system connected with the one or more sensors. In some other embodiments, the control comprises using a computer generated graphic user interface (GUI) button. In some embodiments, the control comprises entering a command using a non-GUI based mechanism.

In another aspect, a communication system for reducing false alarms to a call center comprises a monitoring system connected with one or more security sensors, a notifying device coupled with the one or more security sensors, wherein the notifying device sends out alarm triggered notification signal, and a user's mobile device configured to filter false alarms by a user.

In some embodiments, the mobile device is configured to receive a command for dismissing the false alarms. In other embodiments, the mobile device is configured to dismiss the false alarms by receiving a user's voice command. In some other embodiments, the mobile device is configured to dismiss the false alarms by verifying a user's identity and permission level using one or more biometric identifiers.

DETAILED DESCRIPTION OF THE INVENTION

Figure 1:
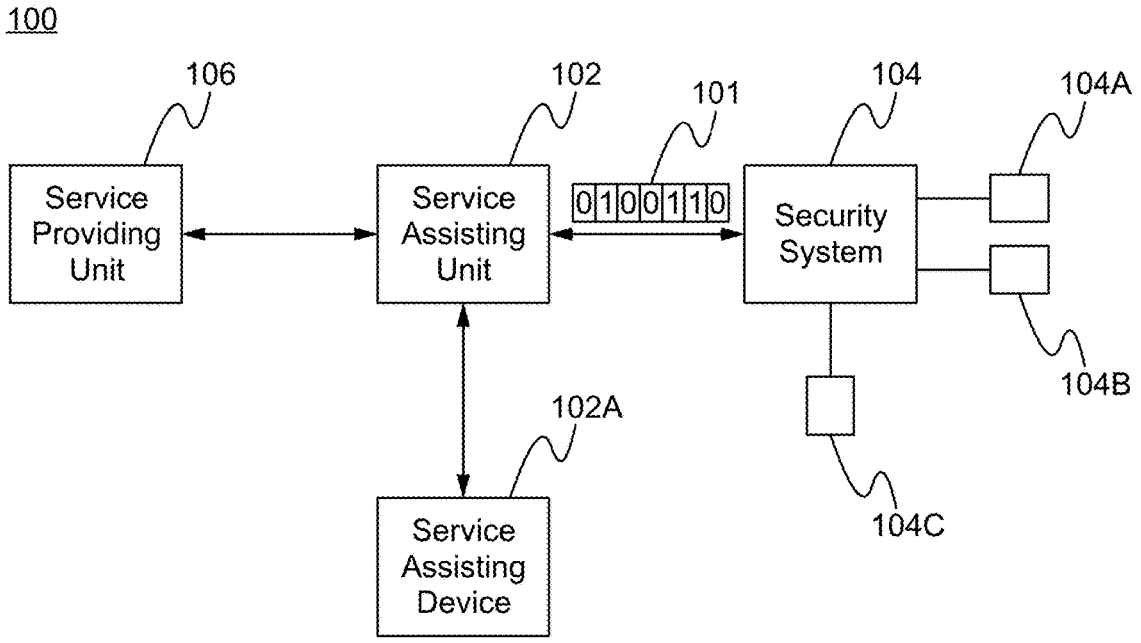
FIG. 1 illustrates a method of providing assistance to a service providing unit in accordance with some embodiments.

FIG. 1 illustrates an assisted service providing method 100 in accordance with some embodiments. In some embodiments, the method 100 includes a service providing unit 106, a service assisting unit 102, and/or a security system 104.

In some embodiments, the service providing unit 106 comprises a call center, a helpline responding center, or a Tele-medical call center. A person of ordinary skill in the art appreciates that the service providing unit 106 can be any real time/instant responding center. In some embodiments, the service providing unit 106 provides live person service, such as direct human verbal, text, or both responding services.

In other embodiments, the service providing unit 106 provides a machine responding service, including pre-recorded responding messages or instantly/event based machine generated response. For example, a machine provides an artificial intelligent (AI) trained verbal, text, and both responding service. In some other embodiments, a hybrid live person and machine mixed responding service is provided. For example, a live person is performing the initial greeting with asking critical questions as a portion of response and an AI machine performs basic information gathering as the second portion of the response.

In some embodiments, the service assisting unit 102 comprises a service assisting device 102A. In some embodiments, the service assisting unit 102 and/or the service assisting device 102A are/is used to reduce the resources needed for providing adequate service level (e.g., less than 20 seconds waiting time) at the service providing unit 106. In some embodiments, the unit 102 and/or the device 102A comprises electric circuits and/or software blocking, eliminating, reducing, avoiding, and/or preventing false calls. With the reduction of the false calls to the call center, the resources needed at the call center and/or dispatch center can be reduced.

The resources needed at the call center and/or dispatch center include the number of staff needed, duration of the service, quantity of the service (e.g., questions needed to ask), and/or available call lines/internet/data bandwidth.

The false call includes false triggered alarm, further service unneeded/unwanted (e.g., severity does not require a further service from the call center or dispatch; the user/subscriber would like to take care of the alarm himself/herself; and the user would like to delegate another party to deal with the situation).

In some embodiments, the term "false call" disclosed in the present disclosure includes triggered notifications or triggered alarm notifications that do not need the assistance from the call center or can be disposed by the user. In some embodiments, triggered notifications or triggered alarm notifications include emergency event notification (e.g., break-in alarm, security alarm) and not emergency event notification (e.g., maintenance service notification, such as low battery notification). Any signals from the monitoring system that are able to be screened, filtered, examined, or reviewed by a user to determine whether the signals should be transmitted to the call center/service center are within the scope of the present disclosure.

In some embodiments, the service assisting unit 102 and/or the service assisting device 102A are/is used to reduce/assist services needed at the service providing unit 106. For example, some data collection or situation/background profiling has been performed partially or entirely at the unit 102 and/or device 102A.

In some embodiments, the service assisting unit 102 comprises/is implemented in a computer server. The computer server can be a server of a service providing company, such as a home security company, commercial security company, a call center, or a health care/emergency responding service providing company. The computer server can also be a third party server that provides service or information to the service providing company.

In other embodiments, the service assisting unit 102 comprises of a computing chip that is contained in a server or a personal electronic device (e.g., smart phone, iPad, or a mobile device). In some other embodiments, the service assisting unit 102 comprises an APP/software executable in a computer server or a personal electronic device (e.g., smart phone, iPad, or a mobile device, which can be the device 102A). In some embodiments, the APP can be downloaded from an APP store, such as Apple Inc's App store. A person of ordinary skilled in the art would appreciate that the unit 102 and/or the device 102A can be used alone, together in part or entirely, or interchangeably as software and/or hardware structured/constructed to perform the functions described herein.

In some embodiments, the assisted service providing method 100 sets a predetermined amount/ratio of a triggered warning signals 101 (e.g., a triggered home security monitoring system) to be processed at the service assisting unit 102 before the warning signals 101 to be further processed by the service providing unit 106. In some embodiments, all or a substantial ratio (e.g., greater than 50.1%) of the triggered warning signals 101 are processed at the service assisting unit 102 before the service providing unit takes any service actions.

In some embodiments, the service assisting unit 102 and service providing unit 106 both receive the triggered warning signals 101, while having the service assisting unit 102 processing the signals 101 before further actions are taken by the service providing unit 106. Any sequences of processing the trigger warning signals 101 are within the scope of the present disclosure so long as the service assisting unit 102 provides assistance (e.g., assisted information; dismiss false calls) to the service providing unit 106.

In other embodiments, the service assisting unit 102 receives the triggered warning signals 101, and the triggered warning signals 101 are not further transmitted to the service providing unit 106 unless the triggered warning signals 101 is first processed, filtered, or screened by the service assisting unit 102.

In some other embodiments, the service providing unit 106 receives the triggered warning signals 101, and the triggered warning signals 101 are subsequently transmitted to the service assisting unit 102 from the service providing unit 106. The service providing unit 106 can be in a noted mode or standby mode waiting to take further actions (e.g., initiate call center engagement or dispatch emergency assistance) after the service assisting unit process, filter, verify, or screen the triggered warning signals.

In some embodiments, the triggered warning signals 101 are processed, filtered, verified, or screened based on various criteria. For example, the triggered warning signals 101 are verified not to be a false trigger, so that further actions are needed to be taken. In some examples, the triggered warning signals 101 are screened not to go beyond/reach a predetermined standard or condition, so that the system/device disclosed herein automatically dismiss the alarm or inquire the user whether to dismiss such alarm and not to take further actions. For example, a smoke triggered alarm signal does not reach the criteria of calling a fire department unless the temperature detected is beyond a predetermined temperature, such as 120° C.

In some embodiments, the security system 104 comprises a home security system, a health care monitoring system, or any other monitoring system. The security system 104 can be coupled with or contain various sensors or monitoring devices, such as a motion sensor 104A, a thermal sensor 104B, and/or a health condition monitoring sensor 104C. A person of ordinary skill in the art appreciates that any other sensors or monitoring devices can be coupled with the security system 104. Further, a person of ordinary skill in the art appreciates that the security system 104 can comprise any security or monitoring related components or devices, such as notification/communication components (e.g., an alarm, siren, WiFi, or phone line connections).

In some embodiments, the triggered warning signals 101 include a non-emergency event notification. For example, the security system 104 sends out a general maintenance notification, including a low battery status notification, a phone line status notification, a device performance status/check notification, and any other non-life threatening, non-potential property damage, or non-potential serious bodily harm event notifications.

In some embodiments, both emergency notification and non-emergency notification (e.g., all signals/notifications) are sent to a user's mobile device to be processed, filtered, verified, or screened by the user. The user serves as a filtering/screening mechanism, so that the user decides the course of actions to be taken. For example, a user is able to either dismiss the emergency notification or request a service from the call center. Further, a user is able to either enter an instruction (e.g., "Send Technician on Tuesday") on his/her mobile device. In some embodiments, a user's response to the triggered notification can include a predetermined selection (e.g., a selection menu of "dismiss" and "Notify A Call Center") or a non-predetermined entry (e.g., allowing a user to enter a type-in service instruction.)

In some embodiments, the triggered notification is automatically transmitted to a call center when the triggered notification satisfies a predetermined criterion; whereas, the triggered notification can require a user's filtering action when the triggered notification does not meet the predetermined criterion. A person of ordinary skill in the art would appreciate that the system can be configured to require a user's intervention (e.g., filtering the triggered notification) with any predetermined criteria.

Figure 2:
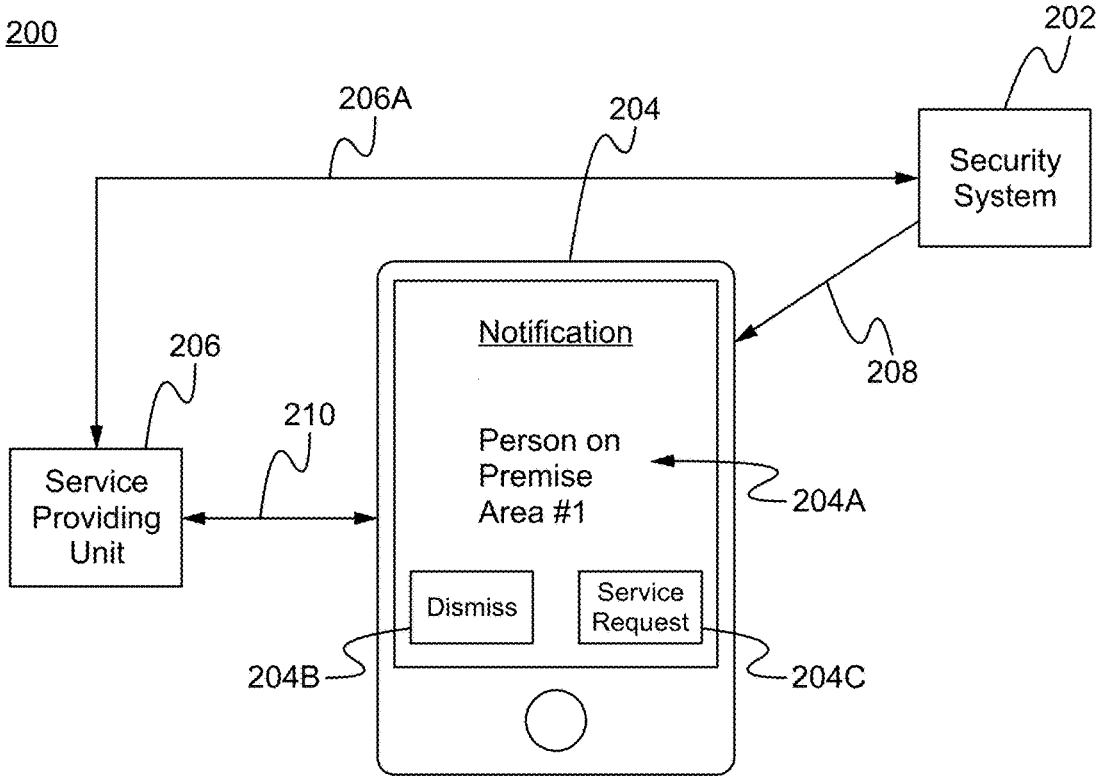
FIG. 2 illustrates a method of filtering false alarm and providing processed information in accordance with some embodiments.

FIG. 2 illustrates a warning signal filtering and/or assisting information providing method 200 in accordance with some embodiments. The method 200 provides an operational process and/or electronic signal communication hardware construction using a user (e.g., a service subscriber) and/or his personal electronic device as a false alarm filtering mechanism or device. In some embodiments, a security system 202 (e.g., a home security system) sends triggered event signals 208 to a user's mobile device 204 (e.g., smart phone). The mobile device 204 contains an installed App or software implemented with a false call reducing or assisting program or App. A triggered event notification 204A (e.g., a break-in event) is displayed on the mobile device 204, which indicates a sensed abnormal status of the monitored premise. A dismiss button 204B and a service requesting button 204C are also shown/displayed on the mobile device 204 via the APP and/or software. When a user clicks/selects the "Dismiss" button 204B, the triggered event signal 208 is canceled. When the user clicks/selects the "Service Request" button 204C, a service requesting signal 210 is transmitted to the service providing unit 206, which can be a call center. The service providing unit 206 can then call a service subscriber or a user of the mobile device 204 to discuss or seek instructions for taking further actions, such as calling police or any other emergency dispatch. In some embodiments, the service providing unit 206 is able to remotely turn off the alarm or re-set the alarm at the security system 202 via one way or two way signals 206A.

In some embodiments, the method 200 can provide an emergency notification filtering mechanism or process, which filters out false alarm signals from the security system 202, such that the resources of the service providing unit 206 (e.g., service person's time and direct communication between the service person and the subscriber) can be used on or only used on filtered/actual service required warning notification signals.

In some embodiments, the method 200 includes at least three signal processing processes: (1) triggered alarm signal receiving, (2) triggered alarm signal filtering and/or verifying, and (3) processing/receiving a user's control command and/or providing further information from the user that is related to the triggered alarm signal (e.g., the user's verbal or text description of the user's knowledge or observation.) The above described process is referred to as User Based Alarm Filtering Method or "UBAF" hereinafter. In some embodiments, the above described process is performed on a user's mobile device, on a remote server, or a combination thereof.

In some embodiments, a triggered notification is sent to the user's mobile device (e.g., the mobile phone 204) for the user to decide the disposition of the notification. In some embodiments, the selections that are provided to the user include "Dismiss" or "Request a Service." For example, a "Dismiss" button 204B and "Service Request" button 204C are provided to the user. In another example, the user is able to verbally provide a command for dismissing the notification or requesting a service. Any other command selections or command manners are within the scope of the present disclosure.

In some embodiments, a service request signal is transmitted from the mobile device (e.g., a mobile phone 204) to a service providing unit when a Service Request is selected. The service providing unit is able to be call center, a law enforcement department (e.g., San Jose Police Department), or any other emergency helping units/organizations. When the emergency helping units/organizations receives service request from the user, proper assistance can be provided.

In an exemplary embodiment, a triggered notification is sent to the user's mobile phone 204 directly from a home security system (e.g., a home security alarm system). In some embodiments, the trigger notification is sent to the user's mobile phone 204 directly without transmitting to a commercial call center. The user is able to decide to dismiss the notification, request a service assistant (e.g., talking to the people at the call center), or request an emergency help/dispatch from a police department. In some embodiments, the trigger notification can be passing on to the commercial call center through the user's command or when the user does not perform an action for a predetermined duration (e.g., 30 seconds). In some embodiments, the triggered notification can be separately sent to the call center and also the user's mobile device. In other embodiments, the triggered notification goes-through the call center's server without been handled by a live person (e.g., for recording purpose) and then transmitted to the user's mobile device for the user to decide an action to take.

In the case when the user dismisses the notification or requests the emergency help/police dispatch, the needed/engaged service level with the commercial call center is reduced or eliminated (e.g., only recording the triggered notification occurrence data without the need for the user to talk to the person at the call center). In such case, the overall call numbers or duration for the users to talk to a designated call center are reduced or eliminated.

Figure 2A:
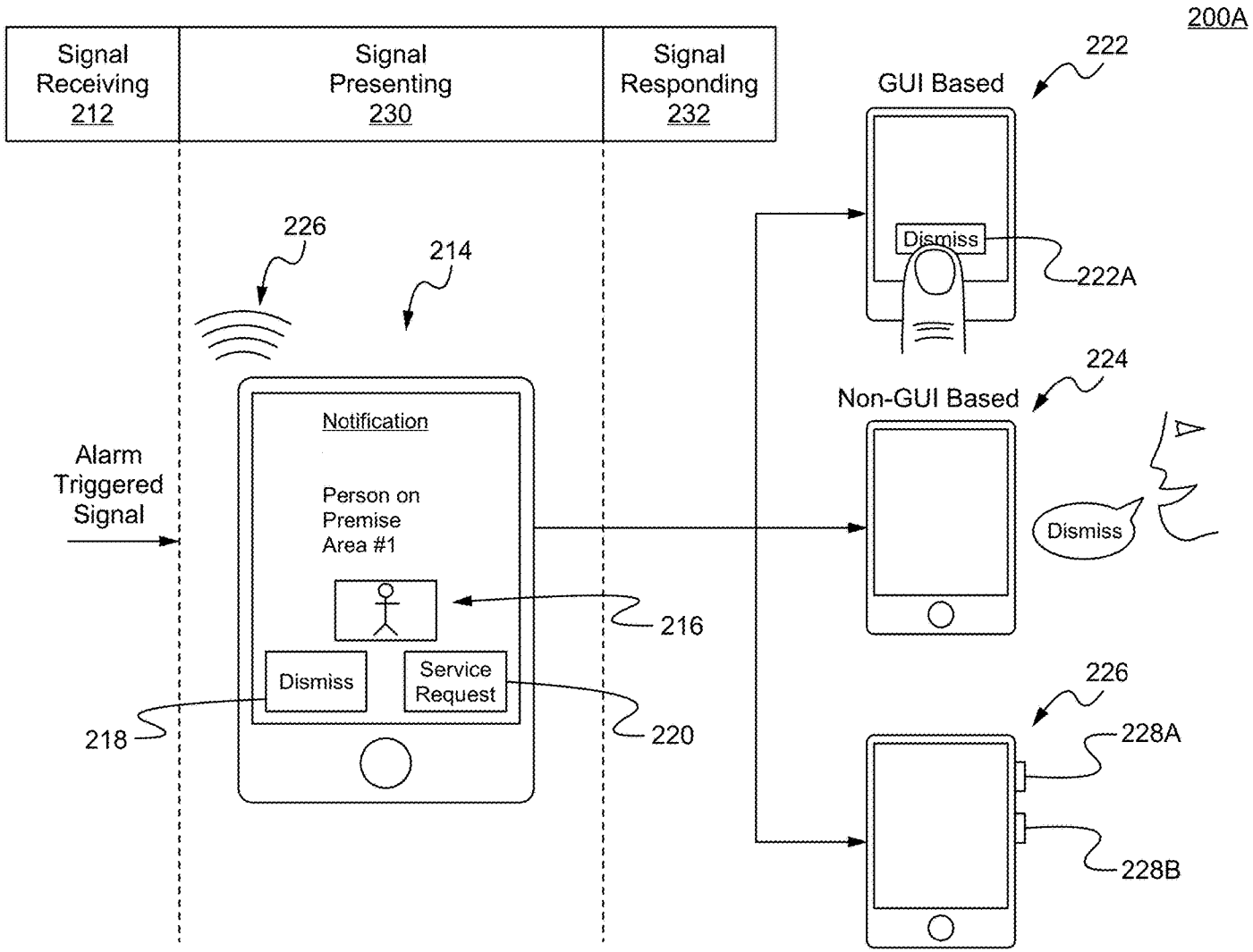
FIG. 2A illustrates a triggered alarm filtering method in accordance with some embodiments.

FIG. 2A illustrates a triggered alarm filtering method 200A in accordance with some embodiments. Similar to the method 200 of FIG. 2 described above, each of the UBAF procedures is able to interface/communicate with the user using a Graphical User Interface ("GUI") based method, a non-Graphic User Interface based ("non-GUI") method, or a combination thereof.

In some embodiments, the GUI based method includes presenting/notifying the user of the triggered alarm signal on a GUI implementable media (e.g., a LCD or LED display on a smart phone; touch screen on the iPhone®), providing the triggered alarm related information (e.g., a video view of the alarm triggered scene), receiving user's commands and inputs, and a combination thereof.

In other embodiments, the non-GUI based method includes presenting/notifying the user of the triggered alarm signal on a non-GUI based implementable media (e.g., a voice command input/output interface, such as using a microphone and loud-speakers on iPhone®; a mechanical button as user's input receiving port), providing the triggered alarm related information (e.g., a video view of the alarm triggered scene), receiving user's commands and inputs, and a combination thereof.

In some other embodiments, a combination of GUI based and non-GUI based method is used to perform the entire or part of the UBAF procedure. For example, the alarm system notifies a user of a triggered alarm event by visually showing the alarm signal information on a display of a user's smart phone (a GUI based method) and the system receives a user's voice input as user's command (a non-GUI based method). In another example, the alarm system notifies a user of a triggered alarm event by both visually showing the alarm signal information on a display of a user's smart phone (a GUI based method) and concurrently a voice announcement of the event (a non-GUI based method). Next, the system is configured to receive either a user's voice input as user's command (a non-GUI based method), a user's finger touch on the touchscreen as an input (a GUI based method), or a combination thereof. A person of ordinary skill in the art would appreciate that a GUI based, a non-GUI based, or a combination thereof can be used to perform any portion of the procedures described above.

In some embodiments, the method 200A comprises a signal receiving process 212, signal presenting process 230, and a signal responding process 232.

At the signal receiving process 212, an alarm triggered signal or notification is received by a user's personal device 214 (such as, a smart phone (e.g., iPhone®) and/or a wearable electronic device (e.g., iWatch®). The alarm triggered signal can be started from one of predetermined sensors, such as a home security motion sensor, a health monitoring sensor (e.g., a fall sensor, a personal emergency response system "PERS"), and an industrial chemical safety sensor. A person of ordinary skill in the art would appreciate that any alarms or sensors that can be configured to monitor or detect an occurrence of a predetermined condition are within the scope of the present invention. Further, the notifications (e.g., the alarm triggered signal) can be transmitted in various forms, such as SMS message, WiFi signals, and any other wired/wireless electronic communications available in the past, today, or in the future. Furthermore, the notification can be formatted in various forms. For example, the notification can contain information containing messages (e.g., additional comments or messages, such as "computer image analysis shows that there are three people at premise"), images, verbal communication, and/or video about the status, condition, and progress of the triggered event. The notification can be either a one-time message, a continuous reporting, and/or periodic updating messages.

At the signal presenting process 230, the notification of the triggered alarm event can be either using the GUI based method, the non-GUI based method, or a combination thereof.

In a GUI based method example, the notification is displayed on a LCD screen of a smart phone 214, wherein the display dynamically shows the notification/notifying message on the screen. A user is able to select or interact with the computer generated graphic based button, such as the dismiss alarm button 218 and the service requesting button 220 displayed on the screen. In some embodiments, the videos and images 216 of the monitored premise are displayed on the screen.

In a non-GUI based method example, the notification is displayed via voice message 226 and/or vibration, which can be communicated to the user in a non-visual only method.

In a combination notification (both GUI based and non-GUI based method) method, the notification can be displayed via the images on the touch screen, voice message 226, vibration, or a combination thereof.

At the signal responding process 232, a user's input (e.g., user's commands, user's responding actions, or user's information providing action) in response to the notification of the triggered alarm event can similarly use the GUI based method, the non-GUI based method, or a combination thereof. For example, a user is able to input their command or actions via the GUI based method, such as selecting the computer generated graphic button 222A of "Dismiss" on the mobile phone 222. In another example, a user is able to input their command or actions via the non-GUI based method, such as the user is able to say the word "Dismiss" as a way of providing voice command 224. In another example, the method 200A can provide an instruction for the user to respond and follow as a way of receiving the user's command. For example, the method 200A causes the mobile phone to speak to the user "select the right side first button 228A to dismiss the alarm and select the right side second button 228B to request a call center to call back for further assistance" on the phone 226.

Figure 2B:
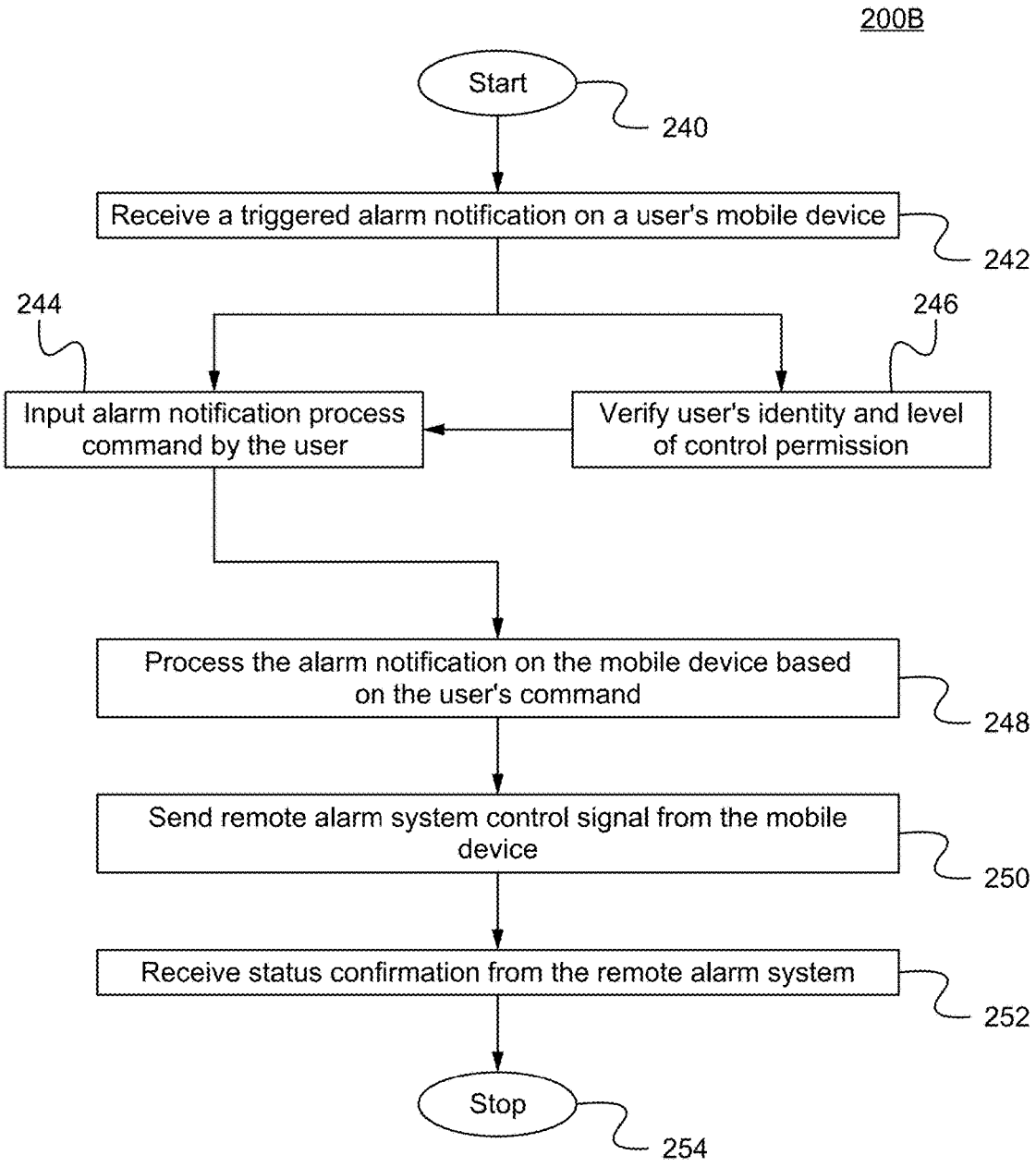
FIG. 2B is a flow chart illustrates an alarm signal filtering method in accordance with some embodiments.

FIG. 2B is a flow chart illustrating an alarm signal filtering method 200B in accordance with some embodiments. The method 200B can start at a Step 240. At a Step 242, a triggered alarm notification on a user's mobile device is received. Various communication methods can be used to transmit the notification signal, such as a telephone signal and an internet signal (e.g., WiFi).

At a Step 244, an alarm notification process command is received from the user by the mobile device or a second electronic device (such as a wearable device, iWatch, Fitbit), or a combination thereof. In some embodiments, the second electronic device receives the user's command (such as, voice command), which is subsequently transmitted to the user's main/first mobile device. In some other embodiments, the second electronic device directly communicates the user's command to a call center or the alarm system. The user's command can include dismiss the notification, dismiss the alarm system, and request further assistance (e.g., request a dispatch of an emergency care person to provide help).

At a Step 248, the alarm notification is processed on the mobile device based on the user's command. For example, when the user inputs a command of requesting further services, the user's mobile device generates a service request signal to be sent out to a service center (e.g., a call center). In another example, the user is able to transfer the notification to another person (such as a secretary, a person who is managing the premise, a person having more knowledge about the alarm triggered event (e.g., the nurse of a senior user)).

At a Step 250, the remote alarm system control signal is sent from the mobile device. For example, the service request signal that is generated/prepared at the Step 248 is transmitted to a call center via the communication system of the mobile device.

At a Step 252, the status confirmation from the remote alarm system is received. For example, the alarm status is received by the user's mobile device. When the alarm is shut off at the alarm system, a status check/status condition notification signal is sent back to the mobile device or the call center as a status confirmation signal.

In some embodiments, a Step 246 of verifying user's identify and control permission is used, which can be performed between any two of the steps described above or concurrently with any of the steps disclosed herein. The above described steps are all optional and can be used or omitted in various embodiments. In some embodiments, the Step 246 is performed between the Step 242 and the Step 244. The identity verification and permission verifying can be performed using various methods and devices. For example, requesting the user to provide a passcode or password or using biometrics (e.g., user's biological data/traits) for verification purpose. The biometrics can be fingerprints, facial recognition, eye iris and retina scanning, voice pattern, speech patterns, and any other physical/behavioral characteristics. The identity verification and/or permission verification can be performed separately or together. In some embodiments, the user's action of allowing their biological data/traits to be verified, which serve as the command of the users' action, such as canceling the alarm by allowing the user's eye scan to be performed.

In an example, when the mobile device receives an alarm triggered notification. The system installed/executed in the mobile device request the user to use their fingerprint to verify and cancel the alarm signal. In some embodiments, once the identity of the user is verified, the system described herein check the permission level of the user in a database stored in the mobile phone, a call center, or any other datacenter locally or remotely. The use is able to make a command based on their assigned permission level.

Figure 3:
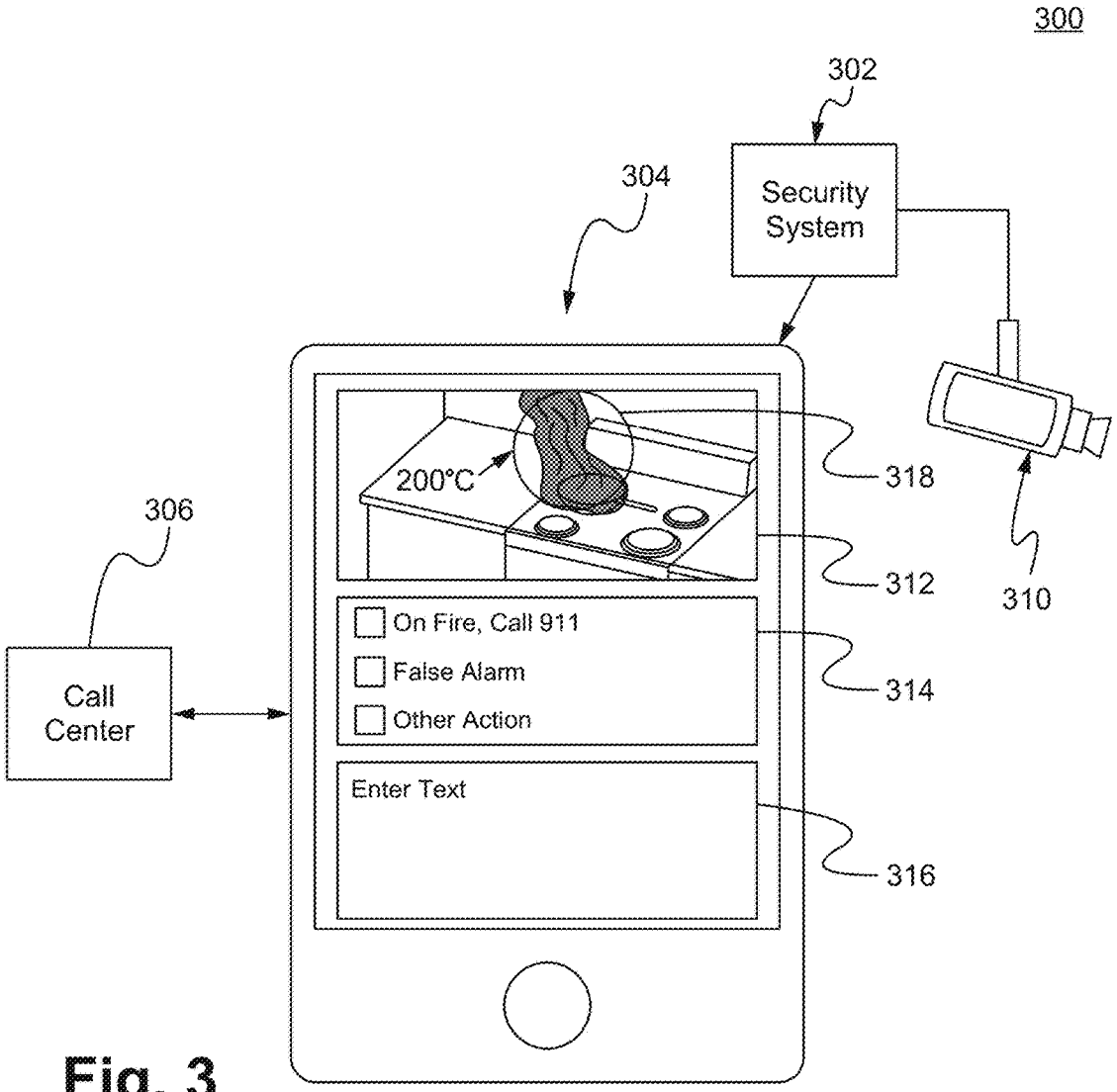
FIG. 3 illustrates a user assisted alarm warning method in accordance with some embodiments.

FIG. 3 illustrates a user assisted alarm warning method 300 in accordance with some embodiments. In some embodiments, the method 300 comprises using a security system 302 having a visual and/or premise conditions monitoring device 310 (e.g., a video camera, a thermal camera, or a chemical substance monitoring device). When the security system 302 sensed a pre-determined triggered event, the security system 302 sends a warning notification to a user assisted device 304 (e.g., user's mobile phone), a visual image/video 312 is displayed on the user assisted device 304. For example, when a curtain is on fire, the thermal image camera 310 provides the visual image/video 312 (e.g., a thermal image/video) highlighting an abnormal thermal event, such as the circle 318 showing that a fire (e.g., abnormal heat event) is detected. The highlighting portion of the image can be enlarged or shown using special image/visual effects, such as showing temperature profile indicating the degree of the temperature (e.g., 200 degree C.). A person of ordinary skill in the art appreciates that any other special image/visual effects can be used as a way to communicate with the user of the abnormal alarm triggering event.

In some embodiments, the user assisted device 304 comprises a selection box for facilitating a check-box style communication, such that the user can efficiently communicate with the operator at the call center 306. A user is able to select one or more check-boxes 314 for assisting the call center 306 to provide faster service without or reducing the needs to analyze the situation by the call center's operator. In other words, the user analyzes the situation and provides conclusion or information, such that the operator of the call center can quickly understand the situation and perform proper assisting actions, such as calling 911 and providing more detailed information for the police to send proper assistance to the monitored premise. For example, for a big fire, a fire station is able to send 3-4 fire trucks to the premise, instead of sending only one fire truck to the premise first to find out if more fire trucks are needed.

In some embodiments, a text or verbal entering message box 316 is provided. The user is able to provide descriptions or communication with the operator at the call center 306, such that the operator at the call center 306 is able to more rapidly understand the situation at the premise.

In some embodiments, the operator of the call center 306 is able to select a portion or all of the messages/information at the check box 314 and/or message box 316 to be forwarded to an emergency assisting place, such as a fire department.

Figure 4:
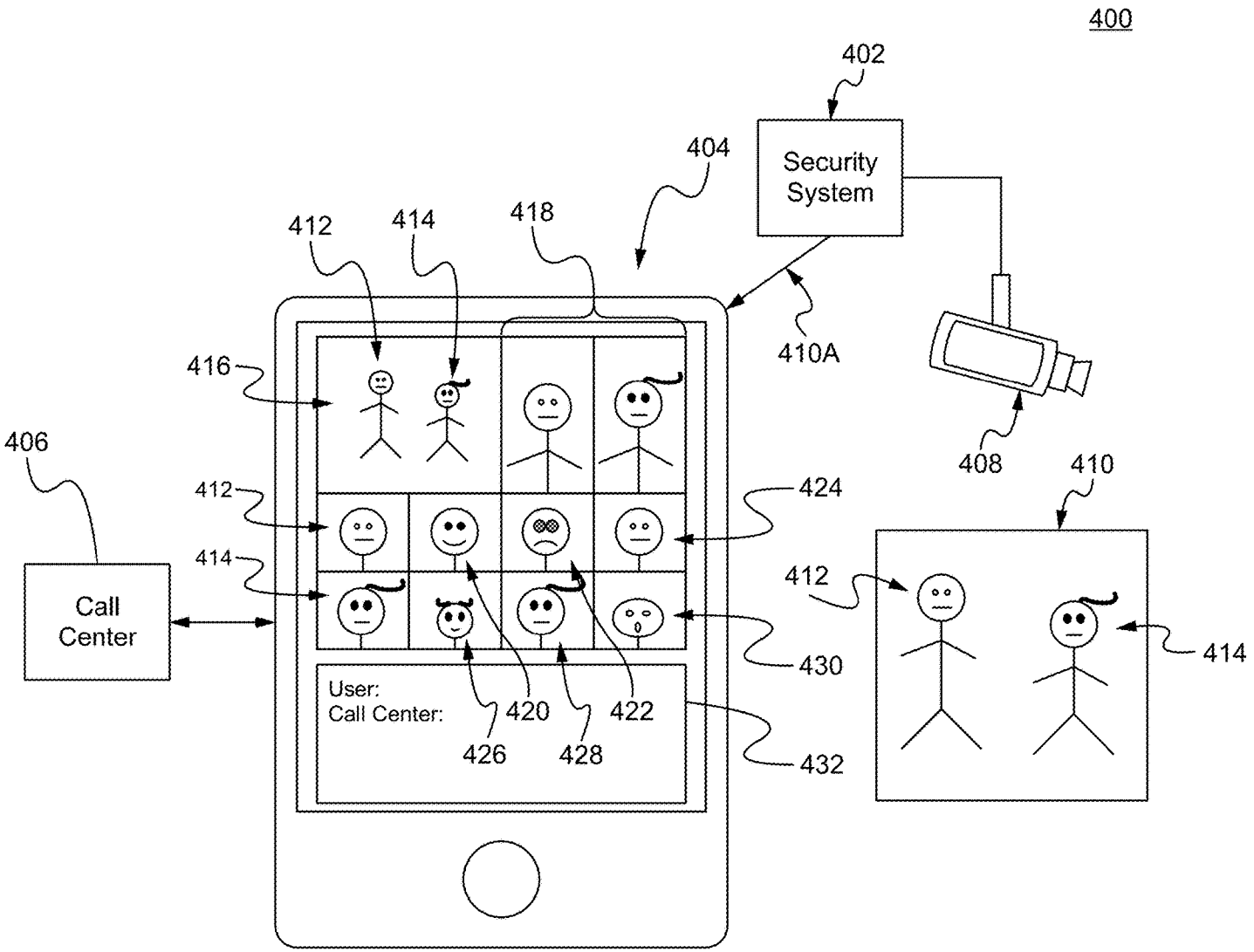
FIG. 4 illustrates a visual enhanced monitoring method in accordance with some embodiments.

FIG. 4 illustrates a visual enhanced monitoring method 400 in accordance with some embodiments. The method 400 is able to monitor a premise using a camera 408. The camera 408 takes a photo or video 410 of the premise constantly and/or an alarm triggered event. The image signal 410A of the premise image 410 is transmitted to a user's assisting device 404. In some embodiments, the image of the premise 410 is displayed on the user's assisting device 404 as a captured image 416, which shows the actually image (e.g., a snap shot) of the premise 410. Two individuals 412 and 414 that are detected by an image analyzing device/software are displayed on a close up/facial view 418. In some embodiments, a focus/zoom-in snap shot photo is further instructed to be taken to more clearly (display) the faces of the detected individuals 412 and 414.

In some embodiments, an image analyzing software is used to compare the headshots of the two individuals 412 and 414 in a computer database. By comparing the photo profiles or biometrics of the headshots 412 and 414, the computer can generates potential matches of the individuals 412 and 414. For example, the faces 420, 422, 424, 426, 428, and 430 are generated/selected by the computer as potential people identified. A user is able to determine and/or select a match helping the call center 406 to identify the person of interests. In some embodiments, a dialog box 432 is able to be used to facilitate the communication between the user and the operator of the call center 406.

In some embodiments, the person (e.g., the user of the mobile device 204 of FIG. 2) who assisted the service providing unit comprises a person having personal knowledge of the monitored premise and/or information related to the monitored premise or the subscriber (e.g., a personal subscriber or a company/entity subscriber). In some embodiments, a passcode is required to authorize a dismissal of the warming notification.

Figure 5:
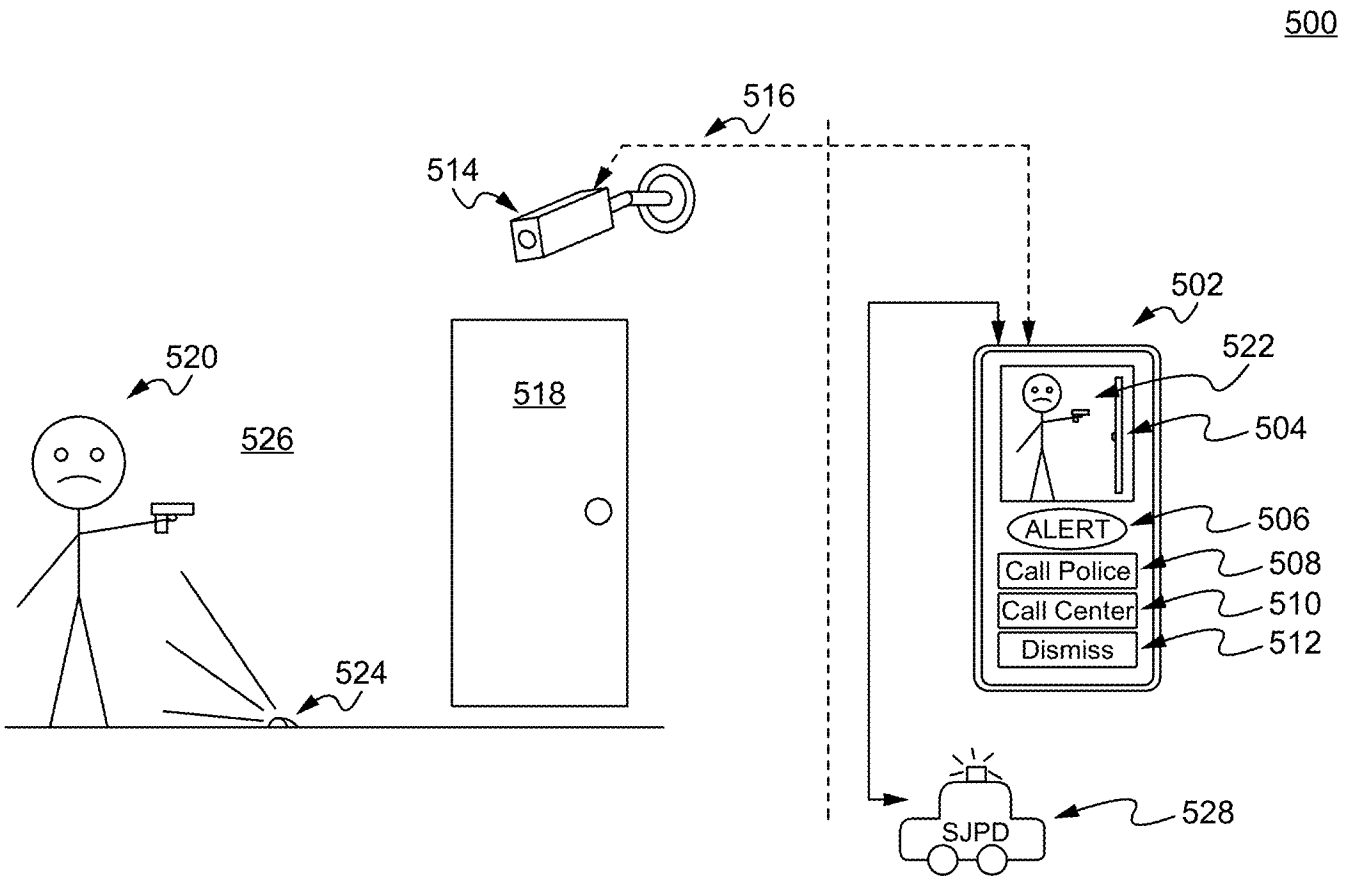
FIG. 5 illustrate a self-monitoring security system 500 in accordance with some embodiments.

FIG. 5 illustrate a self-monitoring security system 500 in accordance with some embodiments. In some embodiments, the system 500 comprises one or more sensors (e.g., motion sensors) for security guarding a premise. When the sensors (e.g., at activated status) senses a person 520 or moving object coming into a predetermined range or place (e.g., a front yard 526 of a house), the system 500 sends a triggered notification 516 to a user's designated device (such as a mobile phone 502) as a notification 506 on the mobile phone 502. The image 504 of the front yard 526 is taken through the camera 514 and transmitted to the mobile device 502, such that the user is able to see the person 520 or object in real-time who is entering into the predetermined range or place. For example, the person 520 at the front door 518 in the front yard 526 is shown in the image/video 504. The user is able to see/identify/enlarge the image 504 having the person 522 on the screen of his mobile phone 502. The user is able to serve as a filer of the triggered notification 516 by selecting one of the calling the police 508, calling the commercial call center 510, or dismissing the notification 512. In some embodiments, the option of calling the commercial call center 510 is not included, such that the user of the system 500 is able to self-monitoring the security of the premise. In some embodiments, the camera 514 generates a sound (e.g., a constant beeping sound) to put the people/invader aware that the camera is recording/functioning.

In some embodiments, the user chooses the selection of calling police 508 when receiving the triggered notification 516. Next, the mobile device 502 sends a dispatch request to a police department 528 using a pre-stored phone number of a local police department (e.g., the police department closest to the premise having the front yard 526.) In some embodiments, the system 500 comprises a pre-stored recording (e.g., voice and/or text) containing the information of the address of the premise and occurrence of the event, such that the police officer can quickly identify the location and come to help. For example, a recorded voice message by a user stating "Break-in notice at my home address at 500 Sierra Pine Street, San Jose, please send an officer to help!" is automatically played via the system 500 to the police department when the user selects the "Call Police" function 508. In some embodiments, a user or a security service provider is able to setup one or more pre-stored phone numbers on the system 500 (such as a local police department, a hospital, and/or a relative), a user is able to select one of the pre-stored number (e.g., click a GUI based button and/or verbally command) for the system 500 to pass on the triggered notification or seeking emergency help.

A person of ordinary skill in the art appreciates that all the functions performed by the devices disclosed throughout the disclosure are able to be performed in a method and procedure as some exemplary embodiments. Similarly, the procedures disclosed herein are able to be implemented using corresponding device or physical/electrical components. For example, when a video recording is disclosed, a video recorder is also disclosed herein.

The term "signal" (e.g., triggered signal or any terms that are used equivalent to signal or in conjunction with the term signal) used throughout the present specification is able to include numerical signal, audio signal, video signal, mechanical signal (e.g., vibration), or a combination thereof.

In utilization, the methods and devices can be used to reduce the call frequency and talking time of a service person in handling false call or emergency situation.

In operation, a warning/triggered notification is first received by a filter (e.g., a service subscribed user) and the user processes the information received before the notification is sent to the call center.

The description is presented to enable one of ordinary skill in the art to make and use the invention. Various modifications to the described embodiments are readily apparent to those persons skilled in the art and the generic principles herein can be applied to other embodiments. Thus, the present invention is not intended to be limited to the embodiments shown but is to be accorded the widest scope consistent with the principles and features described herein. It is readily apparent to one skilled in the art that other modifications can be made to the embodiments without departing from the spirit and scope of the invention as defined by the appended claims.

What is claimed is:

1. A method of reducing a false alarm notification to a call center comprising:

detecting an abnormal event that represents an emergency degree that exceeds a predetermined substantial amount/ratio;

generating a triggered notification in response to occurrence of the abnormal event;

receiving the triggered notification of a security sensor on a user's mobile device;

filtering the triggered notification on the user's mobile device, wherein the filtering comprises dismissing a false alarm of the triggered notification by verifying the identity and permission level of the user on the user's mobile device, highlighting the abnormal event by providing an enlarged image of the abnormal event, providing assisting information to the call center by allowing the user to provide a text or verbal description, wherein the text or verbal description comprises a text or verbal entering message box, providing one or more close-up headshots of a person's captured image by an image analyzing software, and comparing the one or more headshots in a database using the image analyzing software and generating potential matches, wherein the dismissing the false alarm is permitted by prompting the user to perform an eye scan; and reducing resources needed at the call center for providing adequate service level according to the filtered triggered notification.

2. The method of claim 1, wherein the filtering comprises enabling the user to request a service.

3. The method of claim 1, wherein the triggered notification comprises a triggered security alarm.

4. The method of claim 1, wherein the triggered notification comprises a non-emergency event notification.

5. The method of claim 4, wherein the non-emergency event notification comprises a general maintenance notification.

6. The method of claim 5, wherein the general maintenance notification comprises a low battery notification, a service issue notification, or a combination thereof.

7. The method of claim 1, wherein the non-predetermined parameters comprise not-preset selections.

8. A method of reducing a number of false alarm to a call center comprising:

monitoring a premise using one or more sensors;

generating a triggered signal when the one or more sensors detects an abnormal thermal event that represents an emergency degree that exceeds a predetermined substantial amount/ratio;

sending the triggered signal of a security sensor to a user's mobile device;

prompting the user to dismiss the triggered signal for filtering the triggered signal through providing the user a visual effect on the user's mobile device, wherein the filtering comprises highlighting the abnormal thermal event by providing an enlarged image of the abnormal thermal event, providing assisting information to the call center by allowing the user to provide a text or verbal description, wherein the text or verbal description comprises a text or verbal entering message box, providing one or more close-up headshots of a person's captured image by an image analyzing software, and comparing the one or more headshots in a database using the image analyzing software and generating potential matches; and reducing resources needed at the call center for providing adequate service level according to the filtered triggered signal.

9. The method of claim 8, further comprising enabling the user to confirm a trigger emergency event using the user's mobile device.

10. The method of claim 8, further comprising prompting the user to dismiss the triggered signal by entering a command on a computer generated graphic user interface (GUI) button.

11. The method of claim 8, further comprising enabling the user to dismiss the triggered signal by entering a command using a non-GUI based mechanism.

12. The method of claim 11, wherein the non-GUI based mechanism comprises a voice command to dismiss the triggered signal.

13. The method of claim 8, further comprising using the user's mobile device to control an alarm system connected with the one or more sensors.

14. The method of claim 8, wherein the visual effects including a temperature profile of the abnormal thermal event.

15. The communication system of claim 8, wherein the text or verbal description comprises a text or verbal entering message box.

16. The communication system of claim 8, wherein the notifying device comprises pre-stored local law enforcement phone number or pre-stored recording message.

* * * * *